US005149337A

United States Patent [19]

Watanabe

[11] Patent Number: 5,149,337

[45] Date of Patent: Sep. 22, 1992

[54] LENS GRINDER AND METHOD OF GRINDING LENS

[75] Inventor: Masaki Watanabe, Tokyo, Japan

[73] Assignee: Olympus Optical Company Limited, Japan

[21] Appl. No.: 664,414

[22] Filed: Feb. 28, 1991

Related U.S. Application Data

[63] Continuation of Ser. No. 396,688, Aug. 18, 1989, abandoned.

[30] Foreign Application Priority Data

Oct. 20, 1988 [JP] Japan ..... 63-265081

[51] Int. Cl.[5] ..... B24B 1/00; B24B 13/00

[52] U.S. Cl. ..... 51/284 R; 51/284 E; 51/105 LG; 51/106 LG; 51/124 L

[58] Field of Search ..... 51/284 R, 284 E, 124 L, 51/105 LG, 106 LG, 3, 4, 80 R, 81 R, 88, 89, 111 R, 117, 118, 326, 327, 101 LG

[56] References Cited

U.S. PATENT DOCUMENTS

| | | | |
|---|---|---|---|
| 2,078,416 | 4/1937 | Sauer | 51/3 |
| 2,548,277 | 4/1951 | Whittlesey et al. | 51/3 |
| 2,587,926 | 3/1952 | Touvay | 51/117 |
| 2,994,164 | 8/1961 | Dalton | 51/111 R |
| 3,444,652 | 5/1969 | Blum et al. | 51/89 |
| 3,824,742 | 7/1974 | Rupp | 51/284 R |
| 4,409,760 | 10/1983 | Nagaura | 51/284 R |
| 4,497,138 | 2/1985 | Schreiber | 51/3 |
| 5,056,270 | 10/1991 | Curcher | 51/284 E |

FOREIGN PATENT DOCUMENTS

| | | | |
|---|---|---|---|
| 236827 | 3/1963 | Austria | 51/124 L |
| 0023800 | 2/1981 | European Pat. Off. | 51/284 R |
| 2659489 | 7/1978 | Fed. Rep. of Germany | 51/124 L |
| 2807268 | 8/1979 | Fed. Rep. of Germany | 51/284 E |
| U-47669 | 11/1976 | Japan . | |
| 192449 | 10/1984 | Japan . | |
| 152664 | 7/1987 | Japan . | |

*Primary Examiner*—Bruce M. Kisliuk
*Assistant Examiner*—John A. Marlott
*Attorney, Agent, or Firm*—Bruce L. Adams; Van C. Wilks

[57] ABSTRACT

In a lens grinder including work spindle unit having a rotatable work spindle to mount a lens to be ground and a curve generator tool spindle unit having a rotatable curve generator tool spindle to mount an optical functional surface grinding stone to grind optical surface of the lens, a fillet tool spindle unit having a fillet tool spindle to mount a lens periphery grinding stone to grind the lens periphery and fillet, is provided such that the lens can be ground on optical surface, outer periphery and edge, all without remounting the lens so that accurate centering of the lens can be obtained.

13 Claims, 4 Drawing Sheets

LENS GRINDER AND METHOD OF GRINDING LENS

This is a Rule 62 continuation application of Ser. No. 396,688 filed Aug. 18, 1989 now abandoned.

BACKGROUND OF THE INVENTION

1. Technical Field

The present invention relates to a lens grinder and a method of grinding a lens.

2. Prior Art

Lens grinders are known such as shown in Japanese Utility Model Publication No. 51-47669/1976, Japanese Patent Disclosure No. 62-152664 1987 and No. 59-192449/1984.

The above mentioned lens grinder disclosed in the first and second documents performs curve genrator grinding and fillet grinding working. The lens grinder of the first document includes a fillet spindle upward from and 45 degrees to the optical functional surface curve genrator. The fillet spindle is movable in an axial direction and also parallel to and perpendicular to the axis of the curve generator. The lens grinder of the second document does not add specific device and the lens to be worked and the optical functional surface grinding stone are suitably relatively moved to perform curve generator work and fillet grinding work.

Whereas, the lens grinder described in the third document performs the curve genrator grinding and outer periphery grinding by adding an outer periphery grinding stone outward from the curve generator grinding stone.

However, the lens grinder described in the first and second documents can perform the curve generator grinding and the fillet grinding sequentially, bu the outer periphery grinding must be another process. The lens grinder described in the third document can perform the curve generator grinding and the outer periphery grinding sequentially, but the fillet grinding must be other process. Thus, the known lens grinder can perform the curve generator grinding and one of the fillet grinding and the outer periphery grinding of the lens sequentially or simultaneously, however, the three processes of the curve generator grinding, fillet grinding and outer periphery grinding can not be performed simultaneously or sequentially.

Thus, whether the two processes are performed simultaneously or sequentially, the remaining fillet grinding or outer periphery grinding must be performed afterward so that working process is not decreased, and also the grinding of highly accurate centering of a lens especially one having a small Z value and difficult to centering working.

OBJECT OF THE INVENTION

The object of the present invention is to eliminate the above mentioned disadvantages and to provide an improved lens grinder and method of grinding a lens such that the curve generator grinding, the fillet grinding and the outer periphery grinding can be performed simultaneously or sequentially, to decrease lens manufacturing cost and to improve the centering accuracy of the lens.

SUMMARY OF THE INVENTION

The lens grinder, according to the present invention, comprises a work spindle unit having a rotatable work spindle to releasably mount a lens to be worked on at a free end thereof, a curve generator, tool spindle unit having a rotatable, curve generator, tool spindle to releasably mount an optical functional surface grinding stone at a free end thereof to grind the optical surface of the lens, said tool spindle and said work spindle adapted to approach and separate from each other, a fillet tool spindle unit having a rotatable, and axially radially movable, fillet tool spindle to releasably mount a lens periphery grinding stone of the lens at the free end thereof, the rotation axis of said spindle being parallel to the optical axis of the lens.

According to another feature of the present invention, a lens grinder comprises a work spindle unit having a rotatable work spindle to releasably mount a lens to be worked on at the free end thereof, a curve generator, tool spindle unit having a rotatable curve generator tool spindle to releasably mount an optical functional surface grinding stone at the free end thereof to grind the optical surface of the lens, said tool spindle and said work spindle adapted to approach and separate from each other, and a fillet tool spindle unit having a rotatable and axially and radially movable fillet tool spindle to releasably mount a lens periphery grinding stone of the lens at the free end thereof, the rotation axis of the spindle being normal to the optical axis of the lens.

According to the invention, a method of grinding a lens comprises rotation controlling a lens to be ground about the optical axis of the lens, generator grinding optical functional surface of the lens by an optical functional surface grinding stone, and the grinding of the outer periphery and fillet of the lens by an outer periphery grinding stone which is controllably moved parallel to the optical axis and normal to the lens synchronous with the controlling of the generator grinding process.

By the above described lens grinder, according to the present invention, a lens mounted at the free end of the work spindle is rotated and the work spindle and the curve generator tool spindle are drawn relatively near to work curve generator grinding by the optical surface grinding stone. Synchronously or sequentially to the curve generator grinding, the outer periphery grinding stone is approached to the lens and performs fillet grinding and outer periphery grinding. Thus, a lens of high centering accuracy of low cost is manufactured.

DETAILED DESCRIPTION OF THE INVENTION

First Embodiment

Figure 1:
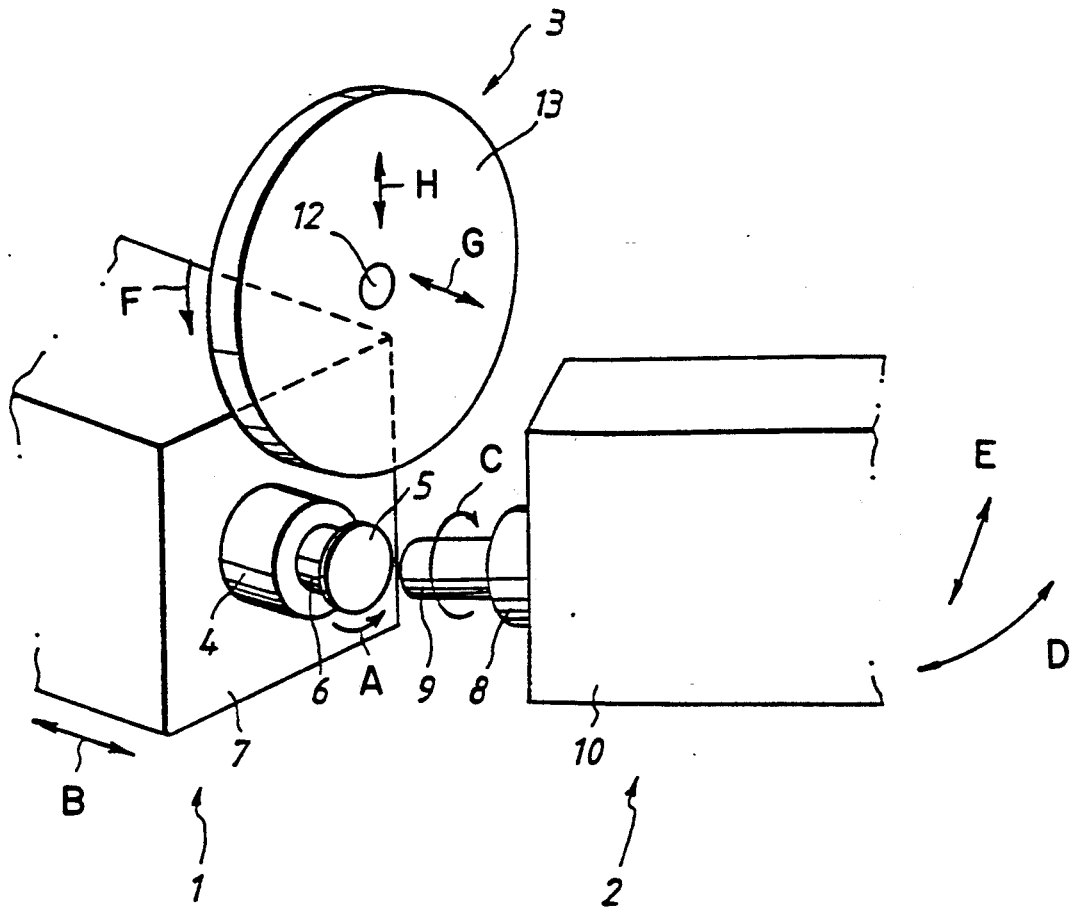
FIG. 1 is a perspective view of a portion of a lens grinder, according to the first embodiment of the present invention.

Referring to FIG. 1 which shows a portion of a lens grinder, according to the present invention, and comprises a work spindle unit 1, a curve generator tool spindle unit 2 and a centering tool spindle unit 3.

The work spindle unit 1 includes a work spindle 4 which has a lens holder 6 at a free end of the spindle to releasably hold a lens 5 or a lens adhered dish. The work spindle 4 is supported by a support 7 to be rotatable as shown by arrow A and axially displaceable.

The curve generator tool spindle unit 2 includes a curve generator tool spindle 8 which releasably mounts an optical functional surface grinding stone 9 at a free end thereof to grind an optical functional surface of the lens 5. The curve generator tool spindle 8 is rotatable as shown by arrow C, and is displaceably supported by a curve generator tool spindle support 10 to maintain the axis of the work spindle 4 which is the optical axis of the lens and the axis of the curve generator tool spindle 8 to be in the same plane. Specifically, the curve generator tool spindle 8 is rockable as shown by arrow D in the plane including the axis of the work spindle 4, i.e., in a horizontal plane, and further displaceable linearly as shown by arrow E which is normal to the axis.

The optical functional surface grinding stone 9 has a generating tip radius of 20 to 30% more than the radius of the lens 5.

Figure 2:
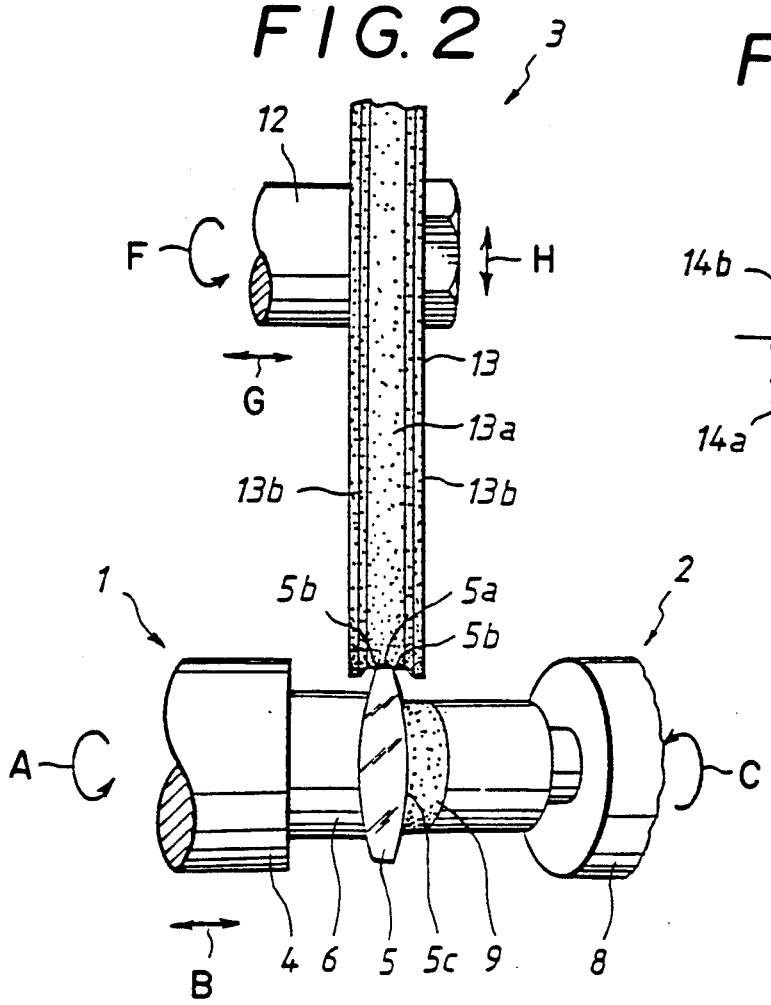
FIG. 2 is a front view of a portion of the lens grinder shown in FIG. 1, FIGS, 3, 4*a* and 4*b* are front views of lenses obtained by lens grinder, according to second embodiment of the present invention.

The centering tool spindle unit 3 includes a centering tool spindle 12 shown in FIGS. 1 and 2 which releasably mounts a disk-like grinding stone 13 to grind outer periphery of the lens 5. The centering tool spindle 12 is rotatable as shown by arrow F and is displaceable parallel to optical axis of the lens 5 as shown by arrow G, and radial to the lens 5 as shown by arrow H.

The outer periphery grinding stone 13 as shown in FIG. 2 includes a peripheral surface grinding stone 13*a* to grind peripheral surface 5*a* of the lens 5, and fillet grinding stones 13*b* to grind peripheral edges 5*b* of the lens 5. On both sides of the disk shaped surface grinding stone 13*a*, thin disk shaped fillet grinding stones 13*b* project radially outward to form tapered edges. The tapered surface of the fillet grinding stone 13*b* corresponds to a desired fillet angle of the lens 5.

In operation, the work spindle 4, the curve genrator tool spindle 8 and the centering tool spindle 12 are rotated, and the work spindle 4 is moved forward axially to engage the lens 5 with the optical functional surface grinding stone 9. Then, the centering tool spindle 12 is moved to engage the outer periphery grinding stone 13*a* with the periphery of the lens 5 as shown in FIG. 2. Workings are performed on the optical functional surface 5*c* and the outer periphery 5*a* of the lens 5 at a cutting speed of 1 to 6 mm/min and at a work spindle speed of 6 rpm.

Then, while spark out grinding of the optical functional surface of the lens 5, the peripheral surface grinding stone 13 is moved axially to perform spark out grinding of the outer periphery of the lens, and to engage the fillet grinding stone 13*b* to the outer edge 5*b* of the lens 5 working fillet and spark out grinding to the outer edge 5*b* of the lens 5. In this operation, the work spindle speed is 20 rpm.

After the curve generator working, the outer periphery surface working and the fillet grinding working are performed, the work spindle 4 is axially retracted to separate the optical functional surface grinding stone 9 from the lens 5, and the centering tool spindle 12 is retracted to separate the periphery grinding stone 13 from the lens 5 to complete the working.

As described, the lens grinder, according to the present invention, performs working of curve generator grinding, outer periphery grinding and fillet grinding of a lens simultaneously with center accuracy without extending cycle time.

The fillet grinding quantity is determined by the lens surface which is adhered on the lens holder 6 whether the lens is newly worked or not. The dimension and shape of the outer periphery grinding stone 13 is not limited to the shape shown in FIG. 2, and is determined by the shape of the lens to be ground.

Second Embodiment

Figure 3:
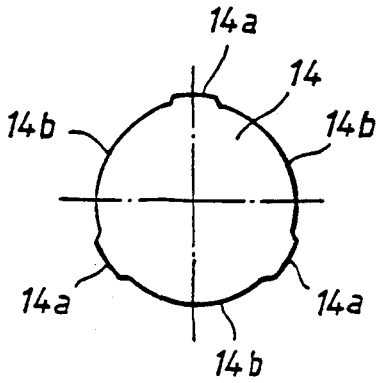

In the second embodiment, the lens grinder shown in the first embodiment is used to work a lens shown in FIG. 3. The lens 14 shown in FIG. 3 forms on predetermined periphery 14*a*, three recesses 14*b* of depth 0.05 mm formed a equidistantly to form center angle of the projected peripheral surface 14*a* of 10 degrees.

To work a lens of 30 mm diameter, a diameter of 160 mm for the outer periphery grinding stone 13*a* is used and the lens is ground as described in the first embodiment to perform working of the outer periphery 14*a* of the lens. Then, the work spindle 4 is stopped and the outer periphery grinding stone 13*a* is rotated and lowered to grind cutting in on the periphery of the lens 14. Then, while the grinding stone 13*a* is driven the work spindle 4 is rotated about 101.4 degree to form first recess 14*b*. Afterward, the outer periphery grinding stone 13 is separated from the lens, and the work spindle 4 is rotated about 18.6 degree to pass one projected surface 14*a*. Then, the second recess 14*b* is ground as described in the working of the first recess 14*b*. The process is repeated to form three recesses 14*b* to complete the lens 14 shown in FIG. 3.

Also in the second embodiment, same functional effect can be obtained as described in the first embodiment.

Figure 4:
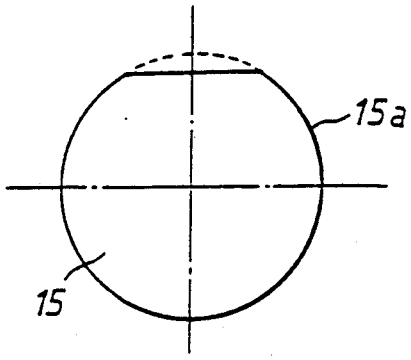
Figure 4:
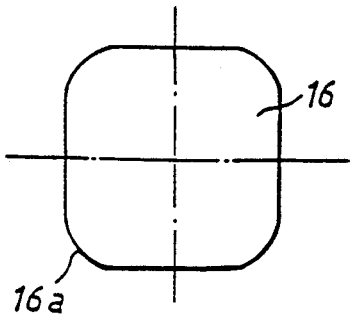

By synchronously controlling the rotation of the work spindle 4 and radial movement of the periphery grinding stone 13, lenses of various shapes such as shown in FIGS. 4*a* and 4*b* can be manufactured. The lens 15 shown in FIG. 4*a* includes one recess on the periphery 15*a*. The lens 16 shown in FIG. 4*b* includes four recesses on the periphery 16*a*.

Third Embodiment

Figure 5:
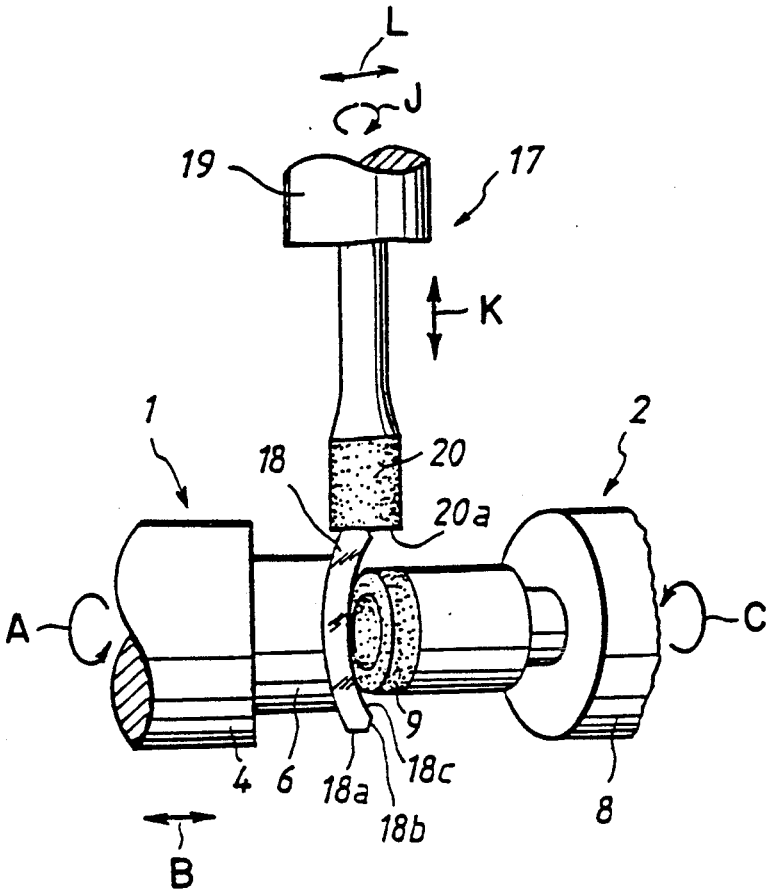
FIG. 5*a* is a perspective view of a portion of a lens grinder, according to third embodiment of the present invention.
FIG. 5*b* is a front view of a portion of FIG. 5*a*, showing outer periphery grinding process.
Figure 5:
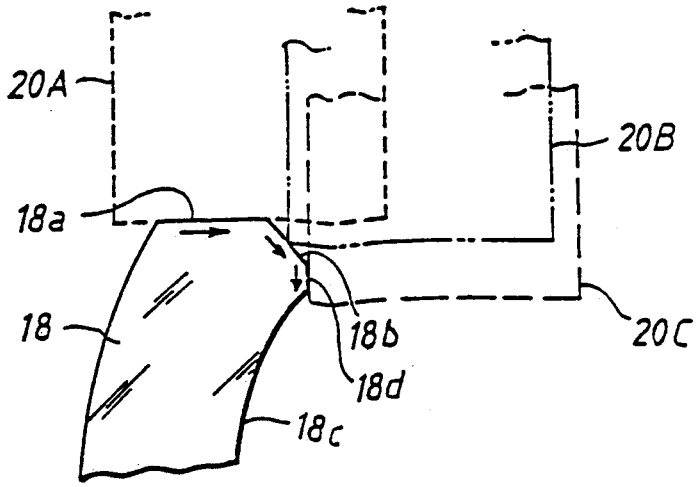

Referring to FIG. 5*a*, a lens grinder, according to a third embodiment of the present invention, is shown, and includes a work spindle unit 1, a curve generator tool spindle unit 2 and a centering tool spindle unit 17. The work spindle unit 1 and the curve generator tool spindle unit 2 are similar with those shown in FIG. 1, and the same reference numerals are used so a detailed description will be omitted. However, the shape of the lens is not the same.

The centering tool spindle unit 17 includes a centering tool spindle 19 which releasably mounts a cylindrical outer periphery grinding stone 20 at free end of the shaft thereof. The centering tool spindle 19 is rotatable as shown by arrow J and is movable axially as shown by arrow K which is normal to an optical axis, and also parallel to the optical axis as shown by arrow L in FIG. 5*a*.

In operation, working to a lens 18 is performed such that the work spindle 4, the curve generator tool spindle 8 and the centering tool spindle 19 are rotated, and the work spindle 4 is moved axially to engage an optical functional surface 18*c* of the lens 18 with the optical functional surface grinding stone 9 to form an optical surface of the lens. Then, the centering tool spindle 19 is moved forward to engage a peripheral surface grinding portion 20*a* of the periphery grinding stone 20 with a peripheral surface 18*a* of the lens 18 as shown in FIG. 5*a* to form a peripheral surface of the lens at a cutting speed of about 1 to 6 mm/min.

Afterward, while the grinding stone 9 works cutting in and spark out grinding on the optical functional surface 18*c* of the lens 18, the outer periphery grinding stone 20 is moved as shown in FIG. 5*b*, from the position 20A to the position 20B and 20C sequentially, to grind peripheral surface 18*a*, peripheral edge 18*b* and edge surface 18*d* of the lens 18. In this working, rotation of the work spindle 4 is increased from 6 rpm to 30 rpm. Then, the work spindle 4 and the centering tool spindle 19 are separated from the lens 18 to complete the working.

According to the lens grinder of the third embodiment of the present invention, advantages described in the first embodiment are also obtained. And further, as the centering tool spindle unit 17 is smaller than the spindle unit 3 shown in FIG. 1, freedom of design of the work spindle 4 and curve generator tool spindle 8 is increased. Also, wide space can be utilized at a working area so that working fluid can be recovered more easily. Wear of the outer periphery grinding stone 20 increases by small diameter than that shown in FIG. 1, however, maintenance and dressing are easy by simple construction.

Fourth Embodiment

Figure 6A:
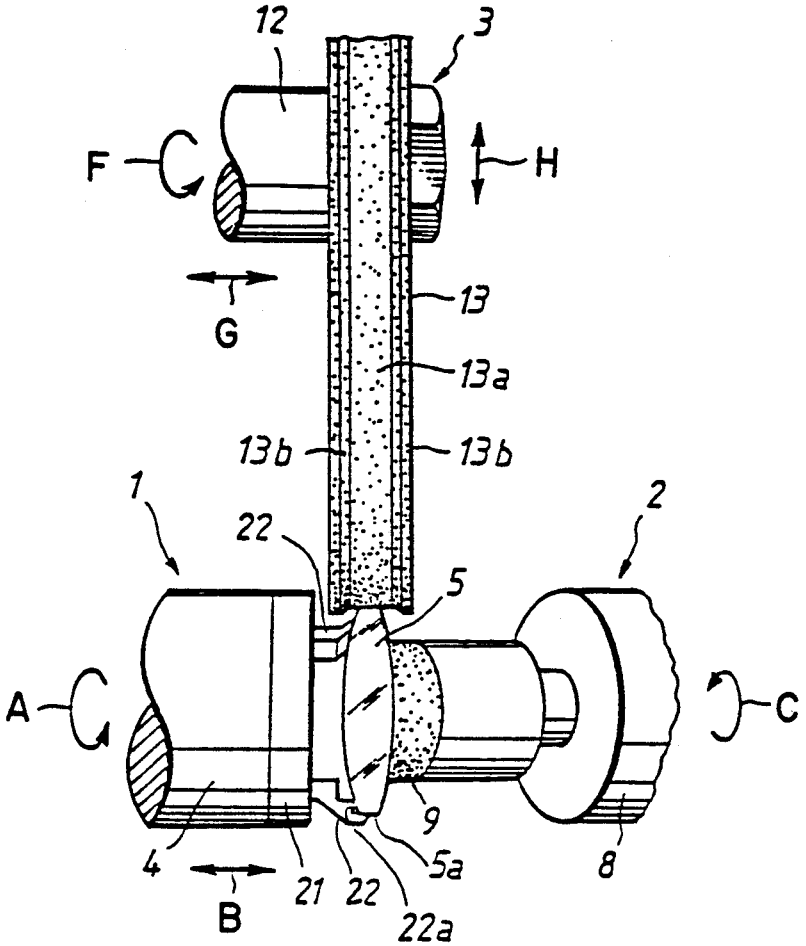
FIG. 6*a* is a front view of a portion of a lens grinder, according to fourth embodiment of the present invention.

A lens grinder, according to the fourth embodiment of the present invention, is shown in FIG. 6*a* and has generally similar construction with that shown in FIGS. 1 and 2 and the same reference numerals are used so a detailed description will be eliminated.

Figure 6B:
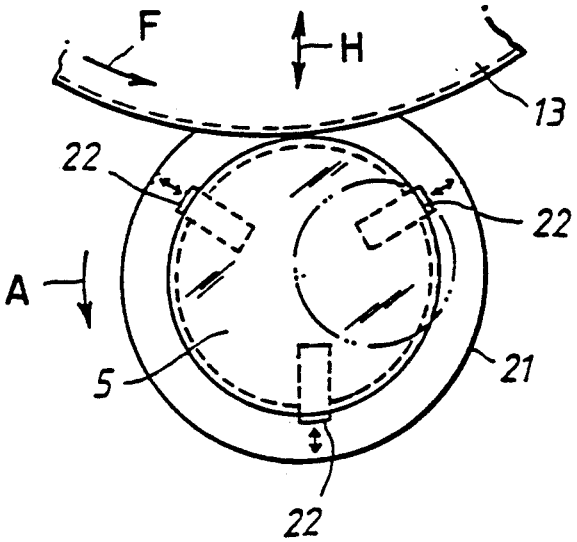
FIG. 6*b* is a side view of a portion of the lens grinder shown in FIG. 6*a* showing outer periphery grinding of the lens.

The lens grinder is different from that shown in FIG. 1 in a lens holder 21. The lens holder or chuck 21 includes three pawls 22 to align an optical axis of the lens 5 with rotation axis of the work spindle 4 and to engage peripheral surface 5*a* of the lens 5. The pawls 22 are shown in FIG. 6*b* and are distributed equidistantly in the lens holder 21. The pawls 22 are movable radially to the center of the lens to hole the periphery 5*a* of the lens 5 to an accurately aligned position. Also, the height of engage end surface 22*a* to engage end surface of the lens 5 is accurately kept in a plane.

In operation, as the pawls 22 of the lens holder 21 hold the periphery 5*a* of the lens 5, the lens grinder can not grind the held periphery by one operation. Thus, as the three recesses are formed in the second embodiment, peripheral grinding and fillet grinding are performed to the portions between the pawls 22 simultaneously with the curve generator grinding on the optical surface. Then, the lens 5 is rechucked on the ground peripheral surface portions and the portions which had covered by the lens holder are ground by peripheral grinding and fillet grinding.

In the embodiment shown, the number of pawls are three, but it is not limited to three. When a collet chuck to hold the all the peripheral surface 5*a* of the lens 5 is used, the outer periphery grinding may be performed in two processes with the curve generator grinding of both surfaces of the lens. In this embodiment, the curve generator grinding, peripheral surface grinding and fillet grinding can be performed on a lens which is not adhered on a lens holder.

In the above described embodiments, the curve generator grinding is performed by axial displacement of the work spindle 4. However, the curve generator tool spindle 8 may be axially moved, or relative axial movement between the spindles 4 and 8 is sufficient. The curve generator tool setting shaft may be used in any known curve generating systems. By the lens grinder shown, the curve generator grinding, the peripheral surface grinding and the fillet grinding may be performed independently if desired.

As described in detail, the lens grinder, according to the present invention, the curve generator grinding, the outer peripheral surface grinding and the fillet grinding of a lens can be performed simultaneously or sequentially in one working process to that the grinding processes and lens mounting process of known working process are greatly eliminated. Thus, manufacturing cost of lenses can be greatly reduced and lenses having high center accuracy can be manufactured easily and automatically.

I claim:

1. A lens grinder comprising:

a work spindle unit having a rotatable work spindle to releasably mount an optical lens to be worked at a free and of the work spindle;

a curve generator tool spindle unit having a rotatable curve generator tool spindle to releasably mount a cup-shaped surface grinding stone at a free end of the curve generator tool spindle to grind an optical surface of the lens to impart a desired curvature thereto, said tool spindle and said work spindle being movable toward and away from each other and said tool spindle being swingable about a center of the lens in a plane that includes the axis of the work spindle;

a fillet spindle unit having a rotatable, axially and radially movable fillet tool spindle to releasably mount a lens periphery grinding stone at a free end of the fillet tool spindle to grind a peripheral surface and peripheral edge of the lens, the axis of rotation of said fillet tool spindle being parallel to the optical axis of the lens; and means for simultaneously rotating the work spindle, the curve generator tool spindle and the fillet tool spindle to effect simultaneous grinding of the lens at the optical surface and the peripheral surface and peripheral edge thereof.

2. A lens grinder comprising:

a work spindle unit having a rotatable work spindle to releasably mount an optical lens to be worked at a free end of the work spindle;

a curve generator tool spindle unit having a rotatable curve generator tool spindle to releasably mount a cup-shaped surface grinding stone at a free end of the curve generator tool spindle to grind an optical surface of the lens to impart a desired curvature thereto, said tool spindle and said work spindle being movable toward and away from each other and said tool spindle being swingable about a center of the lens in a plane that includes the axis of the work spindle;

a fillet tool spindle unit having a rotatable, axially and radially movable fillet tool spindle to releasably mount a lens periphery grinding stone at a free end of the fillet tool spindle to grind a peripheral surface and peripheral edge of the lens, the axis of rotation of said fillet tool spindle being normal to the optical axis of the lens; and means for simultaneously rotating the work spindle, the curve generator tool spindle and the fillet tool spindle to effect simultaneous grinding of the lens at the optical surface of the peripheral surface and peripheral edge thereof.

3. An apparatus for grinding an optical lens, comprising:

holding means for rotatably holding an optical lens to be ground to undergo rotation about a rotary axis;

surface grinding means relatively movable toward and away from the holding means and having a cup-shaped grinding stone rotatable about a first axis for grinding an optical surface of the lens to impart a desired spherical curvature thereto and swingable about a center of the lens in a plane that includes the rotary axis of the holding means;

peripheral surface grinding means relatively movable toward and away from the holding means and having a rotationally driven peripheral surface grinding stone rotatable about a second axis for grinding both a peripheral surface and peripheral edge of the lens, the second axis being parallel to the first axis; and means for effecting the simultaneous grinding of the optical surface and the peripheral surface and peripheral edge of the lens by the surface grinding means and the peripheral surface grinding means.

4. An apparatus for grinding an optical lens, comprising;

holding means for rotatably holding an optical lens to be ground to undergo rotation about a rotary axis;

surface grinding means relatively movable toward and away from the holding means and having a rotationally driven surface grinding stone rotatable about a first axis for grinding an optical surface of the lens to impart a desired spherical curvature thereto and swingable about a center of the lens in a plane that includes the rotary axis of the holding means;

peripheral surface grinding means relatively movable toward and away from the holding means and having a rotationally driven peripheral surface grinding stone rotatable about a second axis for grinding both a peripheral surface and peripheral edge of the lens, the second axis being normal to the first axis; and means for effecting the simultaneous grinding of the optical surface and the peripheral surface and peripheral edge of the lens by the surface grinding means and the peripheral surface grinding means.

5. A lens grinder comprising: a work spindle unit having a rotatable work spindle for releasably mounting a lens to be worked at a free end thereof; a curve generator spindle unit having a rotatable curve generator spindle for releasably mounting a cup-shaped grinding wheel at a free and thereof to grind an optical function surface of the lens, the curve generator spindle and the work spindle being adapted to approach and separate from each other and said tool spindle being swingable about a center of the lens in a plane that includes the axis of the work spindle; a fillet spindle unit having a rotatable, axially and radially movable fillet spindle for releasably mounting a lens periphery grinding wheel at a free end thereof, the axis of rotation of the fillet spindle being parallel to the optical axis of the lens; and means for rotating the work spindle, the curve generator spindle and the fillet spindle, respectively; whereby the work spindle and the curve generator spindle are adapted to approach and to contact the lens with the cup-shaped grinding wheel, and the fillet spindle is movable to contact the periphery of the lens periphery grinding wheel with the periphery of the lens, thereby to perform optical function surface grinding and periphery grinding simultaneously, and thereby to perform lens periphery chamfering by moving the lens periphery grinding wheel until a spark out grinding of the optical function surface of the lens is finished.

6. A lens grinder according to claim 5, wherein a rotational frequency of the work spindle at the spark out grinding of the optical function surface of the lens is larger than that of a rotational frequency of the work spindle at the fillet grinding.

7. A lens grinder, comprising: a work spindle unit having a rotatable work spindle for releasably mounting a lens to be worked at a free and thereof: a curve generator spindle unit having a rotatable curve generator spindle for releasably mounting a cup-shaped grinding wheel at a free end thereof to grind the optical function surface of the lens, said curve generator spindle and said work spindle being adapted to approach and separate from each other and said tool spindle being swingable about a center of the lens in a plane that includes the axis of the work spindle; a fillet spindle unit having a rotatable, axially and radially movable fillet spindle for releasably mounting a lens periphery grinding wheel at a free end thereof, the axis of rotation of said fillet spindle being normal to the optical axis of the lens; means for rotating the work spindle, the curve generator spindle and the fillet spindle respectively; whereby the work spindle and the curve generator spindle are adapted to approach and to contact the lens with the cup-shaped grinding wheel, and the fillet spindle is movable to contact the periphery of the lens periphery grinding wheel with the periphery of the lens, thereby to perform optical function surface grinding and periphery grinding simultaneously, and thereby to perform the lens periphery chamfering by moving the lens periphery grinding wheel in accordance with a fillet chambering contour of the lens until a spark out grinding of the optical function surface of the lens is finished.

8. A lens grinder according to claim 7, wherein a rotational frequency of the work spindle at the spark out grinding of the optical function surface of the lens is larger than that of a rotational frequency of the work spindle at the fillet grinding.

9. A method of grinding a lens comprising the steps of: controlling the rotation of a lens to be ground about an optical axis of the lens, grinding an optical surface of the lens with a cup-shaped grinding stone to impart a desired spherical curvature thereto, and grinding an outer periphery and a fillet of the lens with an outer periphery grinding stone simultaneously with the grinding of the optical surface by controllably moving the outer periphery grinding stone parallel to the optical axis and normal to the lens synchronously with the control of the optical surface grinding.

10. A method of grinding a lens comprising: controllably rotating a lens to be ground about an optical axis of the lens, grinding an optical function surface of the lens by an optical function surface grinding wheel and grinding an outer periphery and fillet of the lens by an outer periphery grinding wheel, the outer periphery grinding wheel being moved in parallel to the optical axis of the lens and normal to the lens in synchronism with the optical function surface grinding wheel.

11. A method of grinding a lens according to claim 10, wherein the fillet grinding of the outer periphery of the lens is performed simultaneously with or after the outer periphery grinding until a spark out grinding of the optical function surface of the lens is finished.

12. A method of grinding a lens according to claim 10, wherein the fillet grinding of the outer periphery of the lens is performed with a higher rotation speed of the lens than during the grinding of the optical function surface of the lens.

13. A method of grinding a lens according to claim 10, wherein after the outer periphery grinding and the fillet grinding of the outer periphery of the lens, the outer periphery of the lens is subjected to notching by rotating the outer periphery grinding wheel when the rotation of the lens is stopped, and the outer contour of the lens is worked by controlling the rotation of the lens and the movement of the outer periphery grinding wheel in a synchronized relation.

* * * * *